US008550508B2

(12) United States Patent
Gentile et al.

(10) Patent No.: US 8,550,508 B2
(45) Date of Patent: Oct. 8, 2013

(54) ANTI-CHUCKING LATCH STRIKER WITH INTEGRAL POP-UP MECHANISM

(75) Inventors: William R. Gentile, Rochester Hills, MI (US); Jason Reznar, Redford, MI (US)

(73) Assignee: A. Raymond et Cie, Grenoble (FR)

( * ) Notice: Subject to any disclaimer, the term of this patent is extended or adjusted under 35 U.S.C. 154(b) by 333 days.

(21) Appl. No.: 13/026,652

(22) Filed: Feb. 14, 2011

(65) Prior Publication Data

US 2011/0198872 A1 Aug. 18, 2011

Related U.S. Application Data

(60) Provisional application No. 61/303,923, filed on Feb. 12, 2010.

(51) Int. Cl.
*E05B 15/02* (2006.01)

(52) U.S. Cl.
USPC ..... 292/341.15

(58) Field of Classification Search
USPC ..... 292/341.15, 340, 341, 341.12 X
See application file for complete search history.

(56) References Cited

U.S. PATENT DOCUMENTS

| | | | | |
|---|---|---|---|---|
| 2,156,874 | A * | 5/1939 | Schonitzer | 292/216 |
| 2,310,548 | A * | 2/1943 | Roethel | 292/341.12 |
| 3,245,709 | A * | 4/1966 | Rosenberger | 292/341.13 |
| 4,911,488 | A * | 3/1990 | Brackmann et al. | 292/216 |

* cited by examiner

*Primary Examiner* — Carlos Lugo
*Assistant Examiner* — Mark Williams
(74) *Attorney, Agent, or Firm* — McDonald Hopkins LLC

(57) ABSTRACT

A striker may engage a latch mechanism of a vehicle—the latch mechanism of the vehicle being capable of being latched and unlatched—to help prevent chucking of the vehicle and to assist in opening a door of the vehicle. The striker may comprise a base, a post attached to the base, a plate positionable relative to the post to a first position adjacent the post and a second position spaced from the post. The striker may further comprise a biasing member engaged with the plate, wherein the biasing member positions the plate to the first position when the latch mechanism is unlatched.

20 Claims, 2 Drawing Sheets

ANTI-CHUCKING LATCH STRIKER WITH INTEGRAL POP-UP MECHANISM

CROSS-REFERENCE TO RELATED APPLICATION

This application claims benefit from U.S. Provisional Patent Application No. 61/303,923, entitled "Anti-Chucking Latch Striker with Integral Pop-Up Mechanism," filed on Feb. 12, 2010, which is hereby incorporated in its entirety by reference.

FIELD OF INVENTION

The present invention is generally related to strikers and, more particularly, to latch strikers having improved noise reduction characteristics.

BACKGROUND

A variety of latching mechanisms have been used within the automotive industry for releasably coupling various movable components to the vehicle body. For example, latches may often be used for releasably coupling doors (e.g., passenger doors, liftgates, hoods, deck lids, trunks, glove boxes, etc.) to vehicles. In order to keep a door of the vehicle in a closed position, a latching mechanism may be provided. Such latching mechanisms may generally be operable in a latched mode to secure the door to the vehicle body and in an unlatched mode where the door is freely movable relative to the vehicle body. Typically, the latching mechanisms may include a latch capable of engaging a striker when the door is in a closed position. The latch may typically be secured near an edge of the door, and a striker may typically be secured to the vehicle body.

Generally, only one edge of a door may be releasably coupled to the vehicle body by way of one or more hinge mechanisms, or the like. A latch may typically be mounted to the edge opposite the hinge mechanism. Also, the side edges of the door may generally not be hinged or physically connected to the vehicle body. Therefore, motion of the vehicle may result in "match-boxing" or non-parallel deflection of the vehicle body relative to the side edges of the door. This match-boxing is undesirable, in part, because it imparts additional vehicle noise, known as "chucking", as the vehicle travels along rough or uneven surfaces.

Often many vehicles with doors, liftgates, deck lids, trunks, or the like, may have issues with distortion of the rear end of the vehicle as the vehicle runs over a rough surface. For example, this distortion may cause significant deflection of the deck lid or trunk relative to the associated deck lid or trunk opening. This deflection may be large enough for contact to be made between the deck lid or trunk and the deck lid or trunk opening or at a high enough frequency that noise emanates from the system.

Manufacturers may often employ a variety of anti-chucking hardware to reduce the chucking resulting from match-box deflection. Common anti-chucking hardware may include wedges and bumpers that may be positioned between the door edges and vehicle body such that some deflection loads from the match-boxing may be transferred to the door.

Vehicles further may include a mechanism that releases a latch remotely. This mechanism, however, often requires additional design changes to be made to the vehicle to account for the size and space required to attach it to the vehicle. Particularly, many of these mechanisms are large and require significant space on the vehicle to attach it thereto. Moreover, in order for an operator to open the part of the vehicle utilizing the release latch, room for the operator's hand may be required. Particularly, the mechanism that releases the trunk or deck lid, for example, may not open such enough for an operator to insert his or her hand. Therefore, a hand opening may be required to be added to the vehicle. Finally, these mechanisms can lead to additional "chucking" of the vehicle as referenced above.

Therefore, there is a need for an improved anti-chucking latch striker with an integral pop-up mechanism that may have a compact size and the efficiently operates to open the part of the vehicle utilizing such mechanism.

SUMMARY

A striker for engagement with a latch mechanism of a vehicle is disclosed, wherein the latch mechanism is capable of being latched and unlatched. The striker may comprise a base, a post attached to the base, and a plate selectively positionable relative to the post from a first position adjacent the post to a second position spaced from the post. The striker may further comprise a biasing member engaged with the plate wherein the biasing member selectively positions the plate to the first position when the latch mechanism is unlatched.

Further, in an alternative embodiment, a striker for engagement with a door of a vehicle is disclosed, wherein the door is capable of being latched to the vehicle and unlatched from the vehicle. The striker may comprise a base capable of attaching to the door, a post attached to the base, and a plate selectively positionable from a first position and a second position relative to the post. The striker may further comprise a biasing member attached to the plate, the biasing member being capable of selectively positioning the plate from the first position and the second position, wherein in the first position the plate is adjacent the post, and wherein the door being latched compresses the biasing member, causing the plate to be positioned in the second position.

Finally, in an alternative embodiment, a striker for engagement with a trunk of a vehicle is disclosed, wherein the vehicle includes a latch mechanism, the latch mechanism capable of being latched and unlatched. The striker may comprise a base, a post attached to the base, the post capable of engaging the latch mechanism, and a plate selectively positionable relative to the post from a first position adjacent the post and a second position, wherein the plate is capable of engaging the trunk. The striker further comprises a biasing member attached with the plate, wherein the biasing member positions the plate to the first position when the latch mechanism is unlatched.

DESCRIPTION OF THE DRAWINGS

Objects and advantages together with the operation of the invention may be better understood by reference to the following detailed description taken in connection with the following illustrations, wherein.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

An anti-chucking latch striker with an integral pop-up mechanism 10 is illustrated in FIGS. 1 through 4. Motion of a vehicle in operation may often result in non-parallel deflection of the vehicle body relative to the side edges of the door, deck lid, trunk, liftgate or any other such opening in a vehicle. The anti-chucking latch striker 10 may lessen this relative motion and reduce or even substantially eliminate the noise concerns. The anti-chucking latch striker 10 may also reduce or substantially eliminate chucking, squeak and rattle concerns in a door closure, such as a side door, liftgate, deck lid, trunk, or the like. The anti-chucking latch striker 10 may further include a pop-up mechanism to assist in opening such door closures of the vehicle upon the latch release. In addition, the anti-chucking latch striker 10 may eliminate the need for additional system parts, such as torsional springs on hinges and the like. Finally, the anti-chucking latch striker with integral pop-up mechanism 10 may be of a compact design capable of requiring very little room on the vehicle to install.

Figure 1:
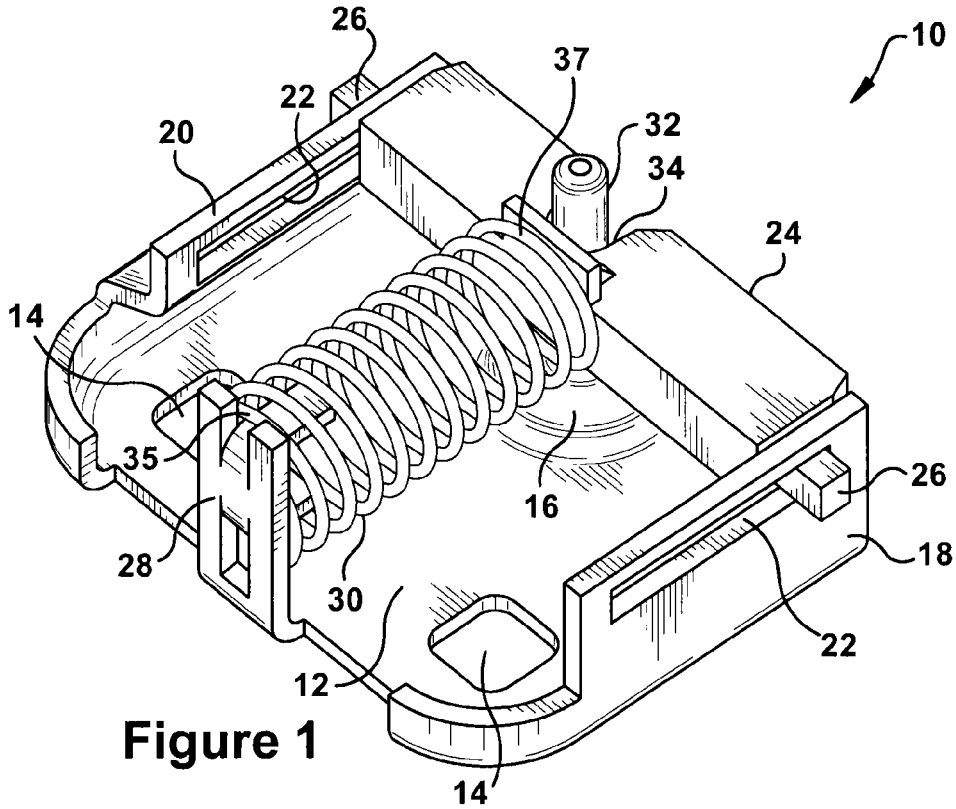
FIG. 1 is a perspective view of an anti-chucking latch striker in an unlatched position.
Figure 2:
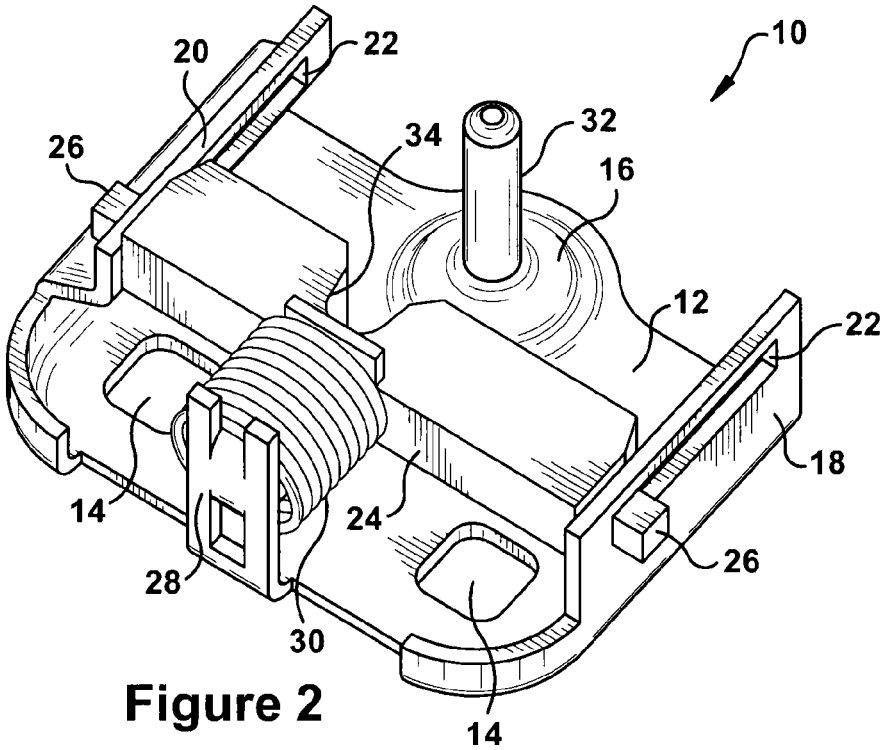
FIG. 2 is a perspective view of the anti-chucking latch striker of FIG. 1 in a latched position.
Figure 3:
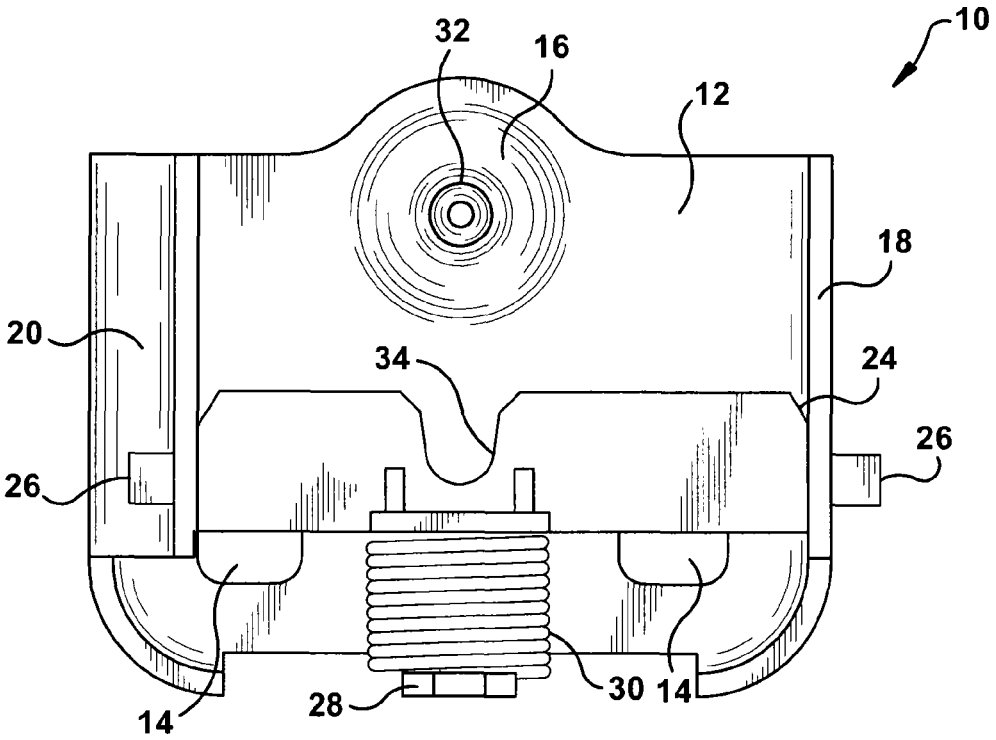
FIG. 3 is a top view of the anti-chucking latch striker of FIG. 2 in a latched position.

The anti-chucking latch striker with an integral pop-up mechanism 10 may include a base 12, a slide plate 24, a biasing member 30 and a post 32, as shown in FIGS. 1 through 3. The base 12 may be of any appropriate shape or size, such as a generally circular, square, triangular or rectangular shape. The base 12 may be of any suitable material, such as any kind of metal, plastic, rubber, or any combination of these materials. The base 12 may include at least one aperture 14. By way of a non-limiting example, the base 12 may include two apertures 14 as is shown in FIGS. 1 through 3. The apertures 14 may be of any appropriate shape or size; by way of non-limiting examples such as a generally circular, square, triangular or rectangular shape. The apertures 14 may be located at any appropriate position on the base 12, such as on opposite sides of the base 12. The apertures 14 may be located on the base 12 to assist with attaching the anti-chucking latch striker with an integral pop-up mechanism 10 to the vehicle. By way of a non-limiting example, the apertures 14 may be positioned on the base 12 to permit a fastener (not shown) to pass through the apertures 14 and into the vehicle at the applicable location to secure the base 12 thereto. Alternatively, the apertures 14 may be positioned on the base 12 such that a fastener may pass through the apertures 14 to secure the base 12 to a latch device attached to the vehicle.

The base 12 may also include a first sidewall 18 and a second sidewall 20 as shown in FIGS. 1 through 3. The sidewalls 18, 20 may be of any appropriate shape or size, such as a generally square, triangular or rectangular shape. The sidewalls 18, 20 may be made of any suitable material. By way of a non-limiting example, the sidewalls 18, 20 may be made of the same material as the base 12, for example, they may be of metal, plastic, rubber, or any combination of these materials. Alternatively, the sidewalls 18, 20 may be made of a material different from that of the base 12. The sidewalls 18, 20 may be generally planar or have a curvature about them. By way of a non-limiting example, the first sidewall 18 may be generally planar while the second sidewall 20 may be of a general "S" shape, and vice versa as shown in FIGS. 1 through 3. The "S" shaped sidewall 20 may assist in positioning the anti-chucking latch striker with an integral pop-up mechanism 10 in the appropriate location on a vehicle by providing the appropriate room for such. The sidewalls 18, 20 may be located at any appropriate position on the base 12, such as being located on opposite sides of the base 12. Each sidewall 18, 20 may include slots 22 shown in FIGS. 1 and 2. The slots 22 may be of any appropriate shape or size, such as a generally oblong or rectangular shape.

The base 12 may also include a backboard or mount 28 as shown in FIGS. 1 through 4. The mount 28 in an exemplary embodiment may be a spring mount 28. The sprint mount 28 may be of any appropriate shape, size, or configuration, such as a generally square, rectangular, triangular or circular shape. For example, the spring mount 28 may be of a general "H" or geometric shape, whereby the biasing member 30 may be mounted thereto. The spring mount 28 may be located at any appropriate position on the base 12, such as towards a generally central location on a side of the base 12 and located between said sidewalls 18, 20 as is shown in FIGS. 1-3.

The slide plate 24 may be selectively positionable relative to the base 12. By way of a non-limiting example, the slide plate 24 may be selectively-positionably attached to the sidewalls 18, 20. The slide plate 24 may be of any appropriate shape or size, such as a generally square, triangular or rectangular shape. The slide plate 24 may be of any appropriate material, such as by way of a non-limiting example, it may be of the same material as the base 12. Or, alternatively, the slide plate 24 may be made of a material different from that of the base 12. The slide plate 24 may include a groove or indentation 34, such as that shown in FIGS. 1 through 3. The groove 34 may be of any appropriate shape or size; by way of non-limiting examples, such as a generally semi-circular or square shape. The groove 34 may be located at any appropriate position on the slide plate 24, such as towards a generally central location on a side of the slide plate 24.

The slide plate 24 may include at least one tab 26. For example, the slide plate 24 may include a pair of tabs 26, as shown in FIGS. 1 through 3. The tabs 26 may be of any appropriate shape or size; by way of non-limiting examples, such as a generally, square, triangular or rectangular shape. The tabs 26 may be located at any appropriate position on the slide plate 24, and may be integrally formed therewith or otherwise attached thereto. For example, the tabs 26 may be located at opposite ends of the slide plate 26, whereby the tabs 26 may be located within the slots 22 of the sidewalls 18, 20 as is shown in FIGS. 1 through 3. The tabs 26 may help guide the slide plate 24 along the sidewalls 18, 20 during operation. Further, the tabs 26 may be of a size and shape such that the tabs 26 do not extend beyond the edges of the base 12, thus creating a compact design. In this embodiment, the anti-chucking latch striker with integral pop-up mechanism 10 is of a compact size that permits attachment to a vehicle without the need for modifying the design of the vehicle to account for such.

The biasing member 30 in an exemplary embodiment may comprise a spring 30. The spring 30 may be of any appropriate shape, size or type of spring. For example, the spring 30 may be an inline compression spring 30 that may be made of any suitable material, such as for example, metal. The spring 30 may be located at any appropriate position on the striker 10, such as shown in FIGS. 1 and 2. For example, a first end 35 of the spring 30 may be mounted onto the spring mount 28. The spring mount 28 may be in a generally central location on a side of the base 12, whereby the spring 30 may be located opposite that of the post 32, as is shown in FIGS. 1 through 4. A second end 37 of the spring 30 may be mounted on or otherwise attached to the slide plate 24. The spring 30 may be mounted to the spring mount 28 and slide plate 24 by any appropriate means. By way of a non-limiting example, the spring 30 may be attached to the spring mount 28 by using a fastening device, adhesives, mechanical attachment, welding, or the like and the spring 30 may be attached to the slide plate 24 by a fastening device, adhesives, mechanical attachment, welding, or the like.

The post 32 may be of any appropriate shape or size, such as a generally cylindrical or tubular shape. The post 32 may be located at any appropriate position on the base 12, such as towards a position opposite that of the spring mount 28 as shown in FIGS. 1 through 3. The post 32 may be of any suitable material, such as by way of a non-limiting example, any kind of metal, plastic, rubber, or any combination of these materials. The post 32 may extend out from and be generally perpendicular with the base 12, as is more specifically shown in FIG. 4. In the unlatched position, the spring 30 may extend the slide plate 24 outwards, whereby the post 32 may be located within the groove 34 of the slide plate 24 as shown in FIG. 1. By way of a non-limiting example, the post 32 may matingly engage a latch of the vehicle (not shown), such as a trunk latch of a vehicle. In this embodiment, the latch (not shown) engages the post 32 to hold the latched item, such as a trunk, in place.

By way of a non-limiting example, the base 12 may also include a boss 16, see FIGS. 1 through 3. The boss 16 may be of any appropriate shape or size, such as a generally circular, square or rectangular shape. The boss 16 may be located at any appropriate position on the base 12, such as adjacent to or at an end of the post 32 as is shown in FIGS. 1 through 3. The boss 16 may be, by way of a non-limiting example, made of any kind of metal, plastic, rubber, or any combination of these materials. The boss 16 may provide for additional structural properties for the post 32 of the striker 10. Specifically, the boss 16 may provide additional structure to the post 32 to help with the strength thereof and potentially reduce the occurrence of premature wear of the post 32.

Figure 4:
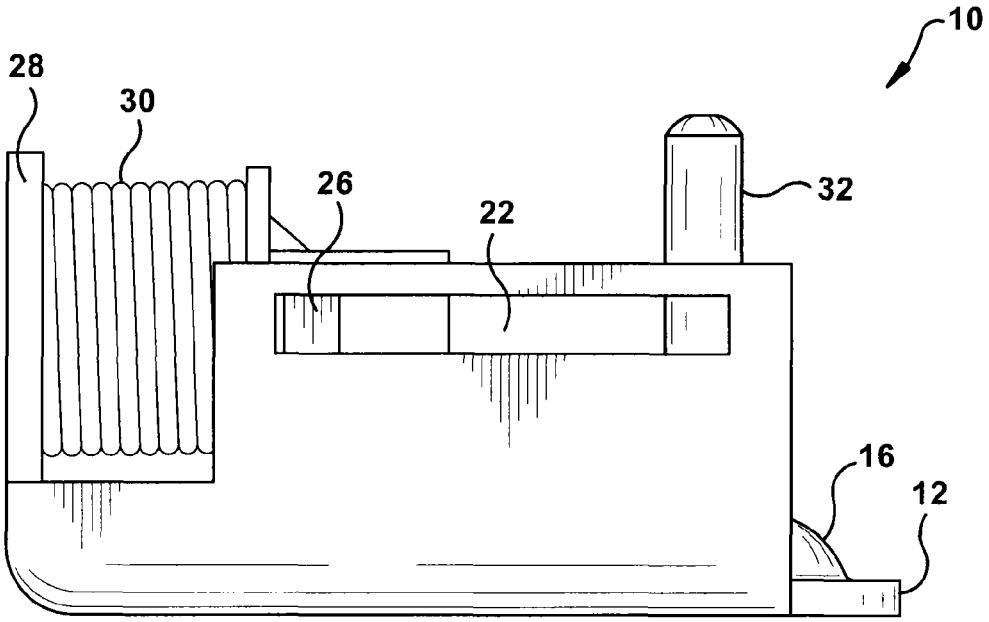
FIG. 4 is a side view of the anti-chucking latch striker of FIG. 2 in a latched position.

In operation, and upon closure of a door (not shown) of a vehicle, the inline spring 30 may be compressed once the door is latched, the position of which is shown in FIGS. 2 through 4. This compression may load the mating latch body components (not shown) and eliminate liftgate or door chucking, such as squeak or rattle. During operation, the spring 30 may ride along the striker wireform post 32 thereby creating a loaded latch for preventing chucking in the closed position. Upon release of the latch mechanism or opening, the compressed spring 30, which is shown in FIG. 1, may release or pop open the door allowing access to the internal compartment of the vehicle. In this embodiment, the release of the compressed spring 30 forces the slide plate 24 toward the post 32. As the door is engaged with the slide plate 24, the door likewise moves toward an open position. In this exemplary embodiment, the spring 30 may have a predetermined load suitable to force open the door of the vehicle a predetermined amount. Specifically, the spring 30 may have a compressibility that selectively positions the slide plate 24 during unlatching to force open the door sufficiently enough that an operator may insert his or her hand between the door and the door opening. This may eliminate the need for additional design elements to be included on the vehicle for the operator to grasp.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

Having thus described the invention, the following is claimed:

1. A striker for engagement with a latch mechanism of a vehicle, said striker comprising:

a base;

a post attached to said base, wherein said post is configured whereby the latch mechanism is capable of engaging and disengaging from said post;

a plate positionable relative to said post to a first position adjacent said post and a second position spaced from said post;

a biasing member engaged with said plate; and wherein the latch mechanism disengaging from said post causes said biasing member to position said plate to said first position and positions the latch mechanism a distance from said post functioning as a pop-up of a door.

2. The striker of claim 1, wherein said post is substantially perpendicular to said base.

3. The striker of claim 1, further comprising first and second walls attached to said base.

4. The striker of claim 3, wherein said first and second walls each include a slot.

5. The striker of claim 4, wherein said plate is slidingly engaged with said slots of said first and second walls.

6. The striker of claim 1, wherein said biasing member comprises an inline compression spring wherein said latch mechanism being engaged with said post compresses said inline compression spring, and said latch mechanism being disengaged from said post releases said inline compression spring.

7. The striker of claim 6, wherein said inline compression spring in said second position causes said plate to apply a load on said latch mechanism.

8. The striker of claim 1, wherein said plate includes a groove whereby when said latch mechanism disengages from said post said groove engages said post.

9. The striker of claim 8, wherein a width of said base is substantially equivalent to a width of said plate.

10. A striker for engagement with a door of a vehicle, said striker comprising:

a base configured to attach to the vehicle;

a post attached to said base, said post is configured such that the door is capable of latching with and unlatching from said post;

a plate selectively positionable to first and second positions relative to said post;

a biasing member engaged with said plate, said biasing member configured to selectively position said plate to said first and second positions; and wherein said door being unlatched from said post decompresses said biasing member moving said plate to said first position and functioning as a pop-up of the door causing the door away from said post.

11. The striker of claim 10, further comprising first and second walls attached to said base, wherein at least one of said first or second side walls is substantially S-shaped.

12. The striker of claim 10, wherein said plate is spaced from said post in said second position.

13. The striker of claim 10, wherein said biasing member comprises a spring having a predetermined compressibility.

14. The striker of claim 13, wherein said spring positioning said plate from said second position to said first position moves said door to an open position.

15. The striker of claim 14, wherein said door opens a predetermined amount based upon said compressibility of said biasing member.

16. A striker for engagement with a trunk of a vehicle, wherein said vehicle includes a latch mechanism, said striker comprising:

a base;

a post attached to said base, said post configured such that the latch mechanism is capable of latching to and unlatching from said post;

a plate selectively positionable relative to said post to a first position adjacent said post and a second position spaced from said post; and a biasing member engaged with said plate, wherein said biasing member positions said plate to said first position when said latch mechanism is unlatched linearly displacing the latch mechanism relative to said post and functioning as a pop-up of the trunk.

17. The striker of claim 16, wherein said biasing member comprises a compression spring having a first end and a second end.

18. The striker of claim 17, further comprising a spring mount, wherein said first end of said compression spring attaches to said spring mount and said second end of said compression spring attaches to said plate.

19. The striker of claim 18, wherein positioning said plate from said second position to said first position opens said trunk a predetermined amount.

20. The striker of claim 16, wherein latching of said latch mechanism to said post positions said plate to said second position and causes said plate and biasing member to apply a load on said latch mechanism.

* * * * *